US008475186B1

(12) United States Patent
Sikkema et al.

(10) Patent No.: US 8,475,186 B1
(45) Date of Patent: Jul. 2, 2013

(54) GUEST CONNECTOR ASSEMBLY

(75) Inventors: Scott D. Sikkema, Grand Rapids, MI (US); Perry DeYoung, Ada, MI (US)

(73) Assignee: Viable, Inc., Grand Rapids, MI (US)

( * ) Notice: Subject to any disclaimer, the term of this patent is extended or adjusted under 35 U.S.C. 154(b) by 112 days.

(21) Appl. No.: 12/903,698

(22) Filed: Oct. 13, 2010

(51) Int. Cl.
*H01R 13/44* (2006.01)

(52) U.S. Cl.
USPC ..... 439/131; 439/502

(58) Field of Classification Search
USPC ..... 439/502, 528, 131; 174/53, 100
See application file for complete search history.

(56) References Cited

U.S. PATENT DOCUMENTS

| | | | | |
|---|---|---|---|---|
| 4,511,198 | A | 4/1985 | Mitchell et al. | |
| 4,551,577 | A | 11/1985 | Byrne | |
| 4,747,788 | A | 5/1988 | Byrne | |
| 4,828,513 | A | 5/1989 | Morrison et al. | |
| 5,023,396 | A | 6/1991 | Bartee et al. | |
| 5,351,173 | A | 9/1994 | Byrne | |
| 5,429,431 | A | 7/1995 | Olson et al. | |
| D406,102 | S | 2/1999 | Byrne | |
| 5,954,525 | A | 9/1999 | Siegal et al. | |
| 6,024,599 | A * | 2/2000 | Stathis et al. | 439/535 |
| 6,028,267 | A | 2/2000 | Byrne | |
| 6,234,812 | B1 | 5/2001 | Ivers et al. | |
| 6,254,427 | B1 | 7/2001 | Stathis | |
| 6,290,518 | B1 | 9/2001 | Byrne | |
| D456,357 | S | 4/2002 | Gershfeld | |
| 6,379,182 | B1 | 4/2002 | Byrne | |
| 6,393,658 | B1 | 5/2002 | Chong | |
| 6,397,762 | B1 | 6/2002 | Goldberg et al. | |
| D472,213 | S | 3/2003 | Byrne | |
| 6,979,209 | B2 | 12/2005 | Griepentrog | |
| 7,064,275 | B2 | 6/2006 | Henriott et al. | |
| 7,083,421 | B1 | 8/2006 | Mori | |
| 7,163,409 | B1 * | 1/2007 | Chen et al. | 439/131 |
| 7,285,733 | B2 | 10/2007 | Bowman | |
| 7,605,330 | B1 | 10/2009 | Black et al. | |
| 7,626,120 | B1 | 12/2009 | Golden et al. | |
| 2008/0200050 | A1 | 8/2008 | Byrne | |
| 2008/0200064 | A1 * | 8/2008 | Chong et al. | 439/571 |
| 2009/0142947 | A1 | 6/2009 | Byrne | |

FOREIGN PATENT DOCUMENTS

| | | | |
|---|---|---|---|
| CA | 1334540 | | 2/1995 |
| CA | 2252929 | C | 10/2006 |
| CN | 201256224 | Y | 6/2009 |
| DE | 102004002838 | A1 | 8/2005 |
| EP | 1182747 | A2 | 2/2002 |
| WO | 2009037666 | A2 | 3/2009 |

* cited by examiner

*Primary Examiner* — Hien Vu
(74) *Attorney, Agent, or Firm* — McGarry Bair PC

(57) ABSTRACT

A guest connection assembly for a surface having a grommet hole comprises an extension cord having a first end adapted to be interconnected to a source and a second end having at least one socket, the first end interconnected with the at least one socket by a cord. A grommet can be received on the cord and have an inner dimension greater than an outer dimension of the at least one socket and a grommet cap can be coupled with the extension cord and adapted to be selectively mounted to the grommet. When the first end of the cord is connected to the source and the grommet is mounted within the grommet hole, the at least one socket on the second end of the extension cord can be selectively exposed and positioned for use by removing the grommet cap from its mounting to the grommet.

17 Claims, 8 Drawing Sheets

GUEST CONNECTOR ASSEMBLY

BACKGROUND OF THE INVENTION

1. Field of the Invention

The embodiments of the invention generally relate to providing connections for electronic devices.

2. Description of the Related Art

Electronic devices such as computers, lap tops, video projectors and phones often require a physical connection through a cable to a source of electrical power and/or data during operation. A variety of systems have been designed to provide a work surface, such as a table or desk, for example, with a receptacle to which a cord of an electronic device can be plugged into.

For example, references such as U.S. Pat. Nos. 6,234,812 to Ivers et al. and 4,828,513 to Morrison et al. and DE102004002838 to Schulte, disclose retractable power strips which are mounted in a work surface.

U.S. Pat. Nos. 4,747,788 to Byrne, 4,551,577 to Byrne and 5,023,396 to Bartee et al. disclose retractable power strips that include mechanisms for sliding or popping-up of the power strip above the work surface in which they are mounted.

U.S. Pat. Nos. 6,028,267 to Byrne and 6,290,518 to Byrne and U.S. Patent Publication No. 2008020050 to Byrne disclose rotatable power strips which rotate from an inaccessible position to an accessible position in the work surface in which they are mounted.

The systems described in the prior art are often large, bulky systems having multiple, moving components which are expensive to manufacture and install. In addition, these systems often take up a lot of surface area on the work surface.

BRIEF DESCRIPTION

According to an embodiment of the invention, a guest connection assembly for a surface having a grommet hole comprises an extension cord having a first end adapted to be interconnected to a source and a second end having at least one socket, the first end interconnected with the at least one socket by a cord. A grommet can be received over the extension cord and have an inner dimension greater than an outer dimension of the at least one socket and a grommet cap can be coupled with the second end of the extension cord and adapted to be positioned with respect to a hole in the grommet so that the extension cord second end is located within the grommet when the grommet cap is positioned above at least a portion of the grommet, the grommet cap having a first portion and the extension cord having a second portion adjacent the second end in alignment with the first portion of the grommet cap connecting the extension cord with the grommet cap. Wherein the source is located at a distance from the grommet in the surface and the extension cord has a length generally greater than the distance between the source and the grommet so that, when the grommet cap is positioned with respect to the hole in the grommet and the extension cord is coupled thereto, the grommet cap can be withdrawn outwardly with respect to the grommet to locate the second end of the extension cord distal to, and in any direction with respect to the grommet. When the first end of the cord is connected to the source and the grommet is mounted within the grommet hole in the surface, the at least one socket on the second end of the extension cord can be selectively exposed and positioned on the furniture item by removing the grommet cap from its mounting to the grommet.

According to another embodiment, at least one of the grommet cap and the grommet further comprises at least one seal positioned at a mating periphery between the grommet cap and the grommet to seal an interface therebetween.

According to yet another embodiment, the grommet hole can be positioned on a horizontal surface of the furniture item. Alternatively, the grommet hole can be positioned on a vertical surface of the furniture item.

According to another embodiment, at least a portion of the grommet cap frictionally engages the grommet to provide resistance against inadvertent removal of the grommet cap from the grommet.

According to another embodiment, the second end of the extension cord comprises a plurality of sockets.

According to another embodiment, the second end of the extension cord comprises a loop and an underside portion of the grommet cap comprises a bar mounted to a rim of the grommet cap and spaced from the underside portion of the grommet cap, wherein the bar is passed through the loop on the second end of the extension cord to mount the second end of the extension cord to the grommet cap.

According to yet another embodiment, one of the second end of the extension cord and the grommet cap comprises a first retainer and the other of the second end of the extension cord and the grommet cap comprises a second retainer, wherein the first retainer is adapted to be coupled with the second retainer to mount the second end of the extension cord to the grommet cap.

According to another embodiment, the first portion of the grommet cap is mounted to the second portion of the extension cord by at least one of an adhesive or a weld.

According to another embodiment, the first portion of the grommet cap is integrally molded with at least the second portion of the extension cord.

According to another embodiment, an outer surface of the grommet cap comprises a grip to facilitate removal thereof from the mounting to the grommet.

According to yet another embodiment, the source comprises at least one of electrical power, a network connection, a video source, an audio source and an audiovisual source. The extension cord can comprise at least one of a power cord, a network cable, a coaxial cable, an audio cable, a video cable, an audio visual cable, and an HDMI cable. The socket can comprise one of an electrical socket, a network cable socket, a coaxial socket, an audio connector socket, a video connector socket, an audio visual socket and an HDMI socket.

According to another embodiment of the invention, a guest connection assembly for a surface having a grommet hole comprises an extension cord having a first end adapted to be interconnected to a source and a second end having at least one socket and a loop, the first end interconnected with the at least one socket by a cord. A grommet can be received over the extension cord and have an inner dimension greater than an outer dimension of the at least one socket. A grommet cap can be adapted to be selectively mounted to a hole in the grommet and have an underside portion comprising a bar mounted to a rim of the grommet cap and spaced from the underside portion of the grommet cap, wherein the bar is passed through the loop on the second end of the extension cord to mount the second end of the extension cord to the grommet cap. When the first end of the cord is connected to the source and the grommet is mounted within the grommet hole in the surface, the at least one socket on the second end of the extension cord can be selectively exposed and positioned for use by removing the grommet cap from its mounting to the grommet.

According to yet another embodiment, a guest connection assembly for a surface having a grommet hole comprises an extension cord having a first end adapted to be interconnected to a source and a second end having at least one socket, the first end interconnected with the at least one socket by a cord. A grommet can be received over the extension cord and have an inner dimension greater than an outer dimension of the at least one socket. A grommet cap can be adapted to be selectively mounted to a hole in the grommet and include an underside having a mechanical fastening bar portion and an attachment portion adjacent to the second end of the extension cord comprising a cooperating mechanical fastening portion for mechanically attaching the extension cord to the grommet cap. When the first end of the cord is connected to the source and the grommet is mounted within the grommet hole in the surface, the at least one socket on the second end of the extension cord can be selectively exposed and positioned for use by removing the grommet cap from its mounting to the grommet.

DESCRIPTION OF AN EMBODIMENT OF THE INVENTION

Figure 1:
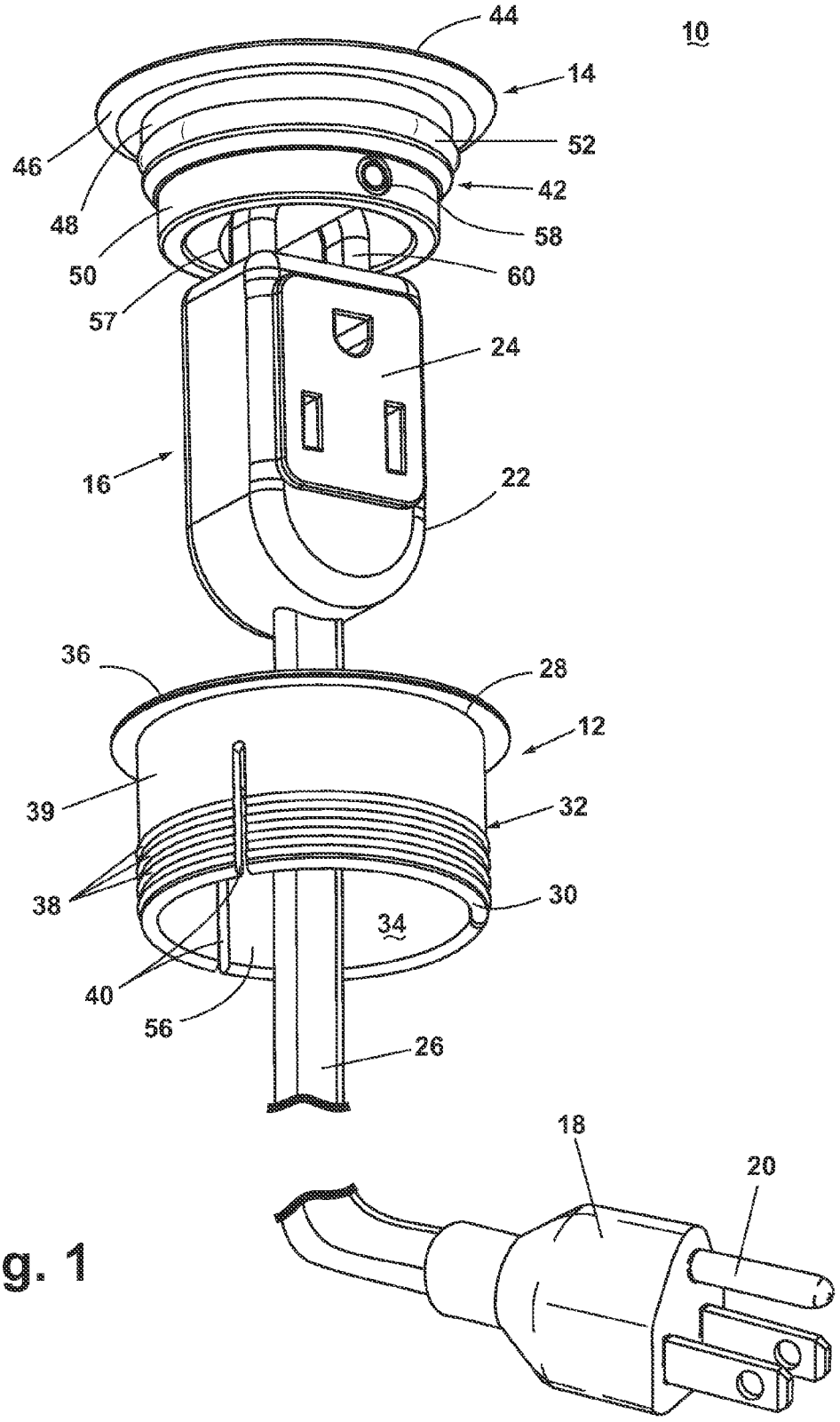
FIG. 1 is a perspective view of a guest connection assembly according to a first embodiment of the invention.

FIG. 1 illustrates a guest connection assembly 10 for use in coupling an electronic device with a source which supplies at least one of electrical power and data to the electronic device. The guest connection assembly 10 is configured to provide a temporary power and/or data connection from a location remote from the guest connection assembly 10 to the electronic device coupled with the guest connection assembly 10. The guest connection assembly 10 can be used in any location in which a temporary electrical power and/or data connection is desired. Non-limiting examples includes restaurants and cafes, waiting rooms, airport lounges, class rooms, auditoriums, retail stores and libraries.

The guest connection assembly 10 comprises a grommet 12 and a grommet cap 14 coupled with an extension cord 16. As used herein, the term extension cord is used to refer to any cord capable of receiving electrical power and/or data from a source and transmitting it over a predetermined distance for delivery to an electronic device which is interconnected with the extension cord.

The guest connection assembly 10 of FIG. 1 is illustrated as comprising an extension cord 16 for receiving and transmitting electrical power. The extension cord 16 includes a first end 18 having a plug 20 for interconnecting to a source of power (not shown) coupled with a second end 22 having a socket 24 by a cord 26. The socket 24 can be a socket for receiving a polarized plug having a ground, as illustrated. Alternatively, the socket 24 can be a socket for receiving a non-polarized plug and/or a socket for receiving a plug without a ground prong. Similarly, the plug 20 can be any suitable polarized or non-polarized plug with or without a ground prong, as is known in the art. The cord 26 can be any electrical cord suitable for use in transmitting electrical power from the source to the socket 24.

The grommet 12 includes a generally circular upper edge 28 coupled with a generally circular lower edge 30 by a sleeve 32 such that the grommet 12 has a generally cylindrical shape defining a hollow channel 34. The grommet 12 can further include a lip 36 extending outwardly from the upper edge 28 for limiting the movement of the grommet 12 within a grommet hole (not shown) in which the grommet 12 is installed. While the grommet 12 is illustrated as having a generally circular shape, the grommet 12 can have any regular or irregular shape. For example, the grommet 12 can have an oval or rectangular shape. An inner dimension of the channel 34 can be selected such that the second end 22 of the extension cord 16 can be received by and pass through the channel 34.

The sleeve 32 can be formed so as to be retained within the grommet hole in which the grommet 12 is mounted. For example, as illustrated in FIG. 1, the sleeve 32 can comprise a series of projections 38 on an outer wall 39 for retaining the grommet 12 within the grommet hole, as is known in the art. The grommet 12 can further be provided with a plurality of slits 40 in the sleeve 32. The slits 40 can provide the sleeve 32 with some amount of flexibility such that the sleeve 32 can resiliently deflect when being pressed into the grommet hole during mounting.

While the grommet 12 is described as being press-fit into the grommet hole, it is within the scope of the invention for the grommet 12 to be mounted within the grommet hole using any suitable mechanical or non-mechanical connectors, such as screws or adhesives, for example. The grommet 12 can be made from any suitable polymeric or metal material.

Figure 2:
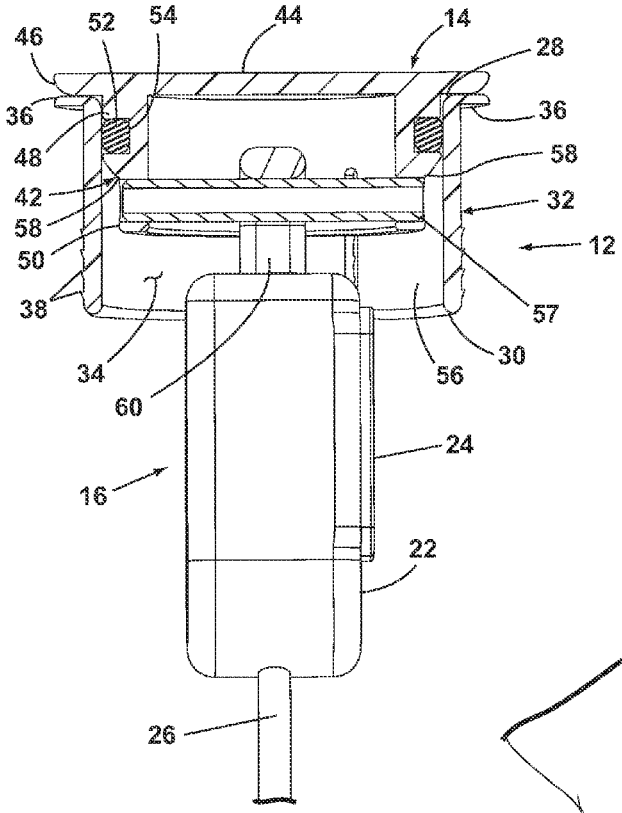
FIG. 2 is a cross-section of the guest connection assembly of FIG. 1 in a mounted position according to the first embodiment of the invention.

Referring now to FIGS. 1 and 2, the grommet cap 14 can comprise a circumferential wall 42 coupled with an upper surface 44 by an outwardly extending rim 46. The circumferential wall 42 can include an upper portion 48 adjacent the rim 46 and a lower portion 50. The upper portion 48 and lower portion 50 can have different outer diameters, as illustrated, or the outer diameters can be the same. The grommet cap 14 can further include a seal 52 which can be in the form of an o-ring, as illustrated. As best seen in FIG. 2, the upper portion 48 can include a circumferential groove 54 for receiving the seal 52 and maintaining it in position on the grommet cap 14.

The diameter of the rim 46 of the grommet cap 14 is sized such that the rim 46 abuts the lip 36 of the grommet 12 when the grommet cap 14 is mounted to the grommet 12, as illustrated in FIG. 2. A maximum outer diameter of the circumferential wall 42 is selected such that the grommet cap 14 can be received within the channel 34 of the grommet 12 in the mounted position. The diameter of the seal 52 is selected such that the seal 52 sealingly mates with an inner wall 56 of the sleeve 32 when the grommet cap 14 is in the mounted position. The seal 52 can be any suitable type of seal, non-limiting examples of which include o-rings, gaskets, spring seals, cap seals and baffles and can be made from any suitable polymeric material. It is also within the scope of the invention for the grommet cap 14 to include a plurality of seals 52. In addition, while the embodiments of the invention are described as having the seal 52 provided on the grommet cap 14, it is understood that the seal 52 can alternatively be provided on the grommet 12 or that both the grommet 12 and the grommet cap 14 can be provided with a seal.

It is also within the scope of the invention for the guest connection assembly 10 to not include a seal 52. In another example, the maximum outer diameter of the circumferential wall 42 may be selected so as to frictionally engage the inner wall 56 of the sleeve 32 without a seal to prevent inadvertent un-mounting of the grommet cap 14 from the grommet 12.

The grommet cap 14 can also include a retaining device 57 for coupling the second end 22 of the extension cord 16 to the grommet cap 14. As illustrated in FIGS. 1 and 2, the retaining device 57 can be in the form of a rod spanning an inner diameter of the lower portion 50 of the circumferential wall 42. Opposite ends of the rod 57 can be received by and removably or irremovably retained within a pair of opposing apertures 58 provided in the lower portion 50 of the circumferential wall 42. For example, the ends of the rod 57 can be secured within the apertures 58 simply by a press-fit or using any other suitable mechanical or non-mechanical fastener, such as a nut or a weld.

The second end 22 of the extension cord 16 can be provided with a curved fastener 60, such as a hook or loop, for example, which can receive the rod 57 for coupling the extension cord 16 with the grommet cap 14. The upper surface 44 of the grommet cap 14 can also be provided with one or more grips, such as a handle, loop or tab, to facilitate grasping and un-mounting the grommet cap 14.

Figure 8:
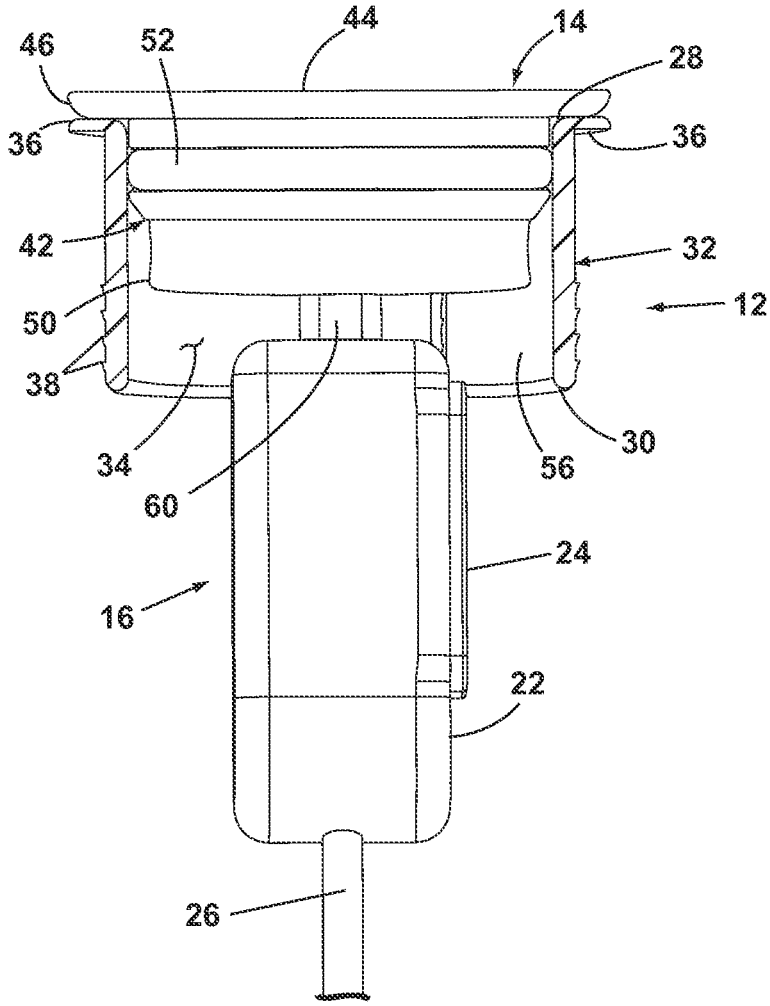
FIG. 8 is a perspective view of a guest connection assembly according to an embodiment of the invention with a portion of the guest connection assembly shown in cross-section.

It is also within the scope of the invention for other retaining devices to be used to couple the grommet cap 14 with the extension cord 16. For example, the second end 22 can be coupled with an underside of the grommet cap 14 using an adhesive or weld. In another example, the grommet cap 14 can be provided with a clamp or spring clip for grasping the second end 22 of the extension cord 16. In yet another example, as illustrated in FIG. 8, the grommet cap 14 can be integrally molded with the second end 22 such that the grommet cap 14 and the extension cord 16 comprise a single piece.

Figure 3:
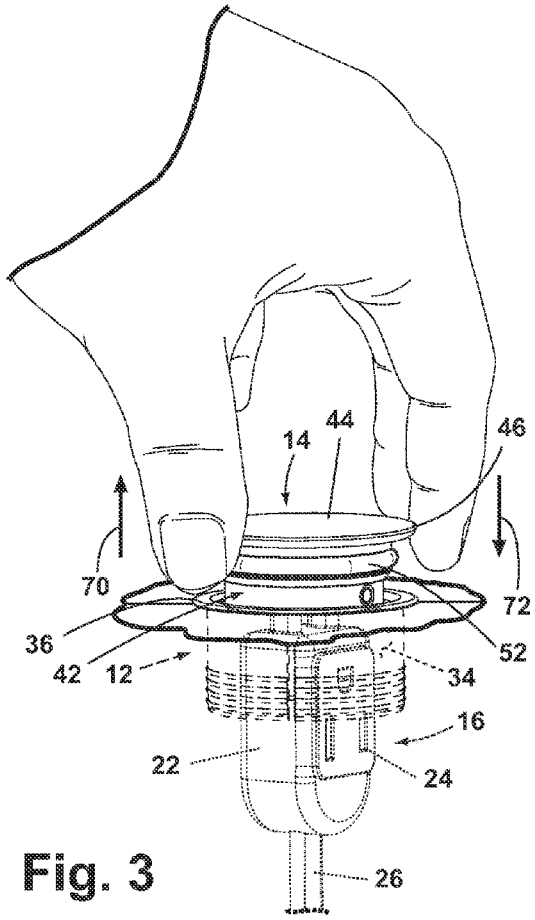
FIG. 3 illustrates the movement of the guest connection assembly of FIG. 1 between an un-mounted and mounted position according to a second embodiment of the invention.

Referring now to FIG. 3, in use the guest connection assembly 10 can be moved from a mounted position, in which the grommet cap 14 is mounted within the grommet 12, to an un-mounted position in which the grommet cap 14 has been pulled away from the grommet 12 and the extension cord 16 is extending through the channel 34 of the grommet 12. Un-mounting the grommet cap 14 provides access to the socket 24 to which a user can connect an electronic device. A user can un-mount the grommet cap 14 by grasping the grommet cap 14 around the rim 46 and pulling upwards and away from the grommet 12, as illustrated by arrow 70. Similarly, the user can mount the grommet cap 14 to the grommet 12 when the socket 24 is not in use by moving the grommet cap 14 in the reverse direction, as illustrated by arrow 72 and inserting the grommet cap 14 in the channel 34 of the grommet 12. The diameter of the rim 46 can be provided such that the rim abuts the lip 36 of the grommet 12 when the grommet cap 14 is inserted in the channel 34, limiting the depth with which the grommet cap 14 can be inserted into the grommet 12.

Figure 4A:
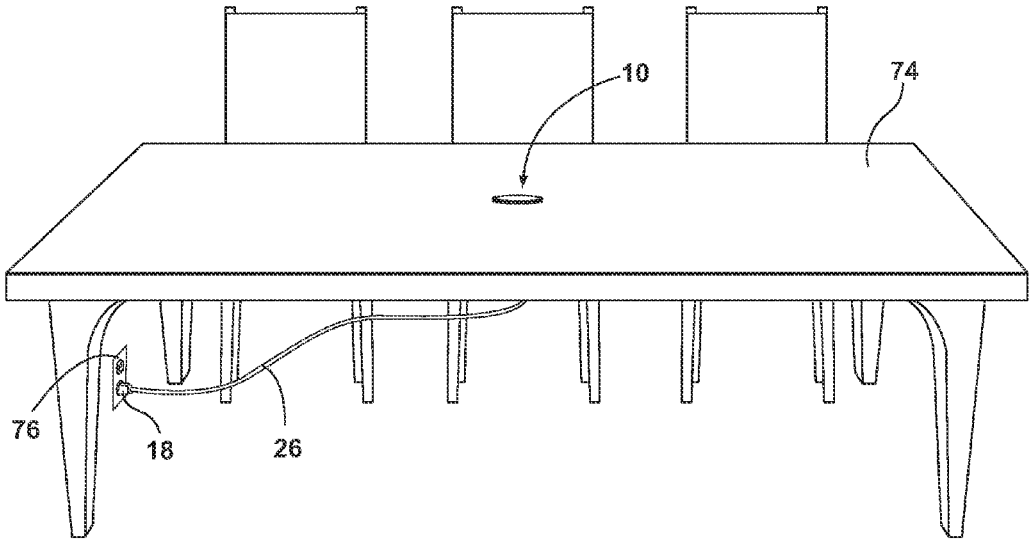
FIGS. 4A and 4B illustrate a method of use of a guest connection assembly on a horizontal surface according to a third embodiment of the invention.
Figure 4B:
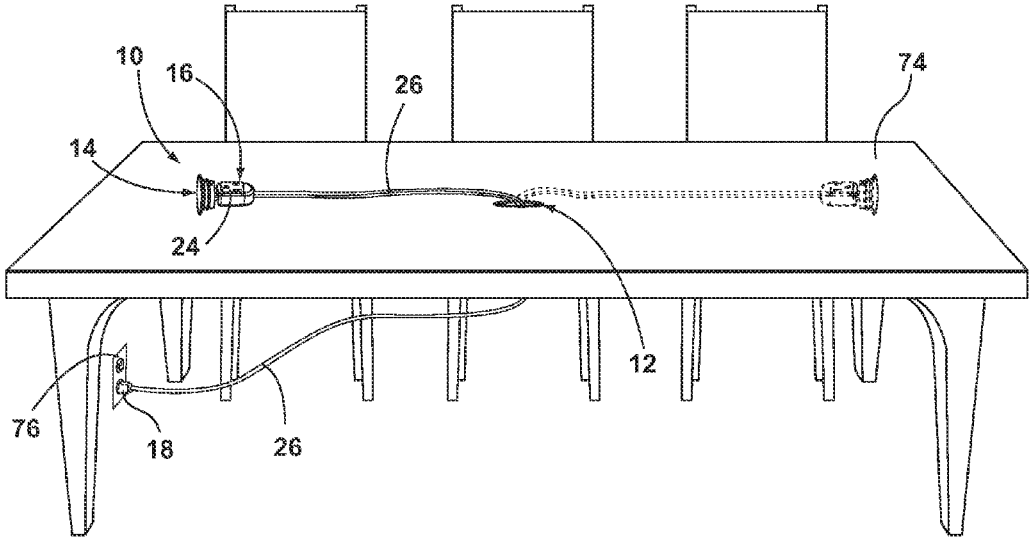

FIGS. 4A and 4B illustrate the use of the guest connection assembly 10 on a horizontal work surface 74, such as a table. Other non-limiting examples of horizontal work surfaces in which the guest connection assembly 10 can be installed include a desk, countertop, bar, work bench, lab bench, floor and ceiling. The guest connection assembly 10 can be installed in a grommet hole provided in a surface of the table 74. When not in use, as illustrated in FIG. 4A, the guest connection assembly 10 takes up very little room on the surface of the table 74 and underneath the table 74.

To use the guest connection assembly 10, a user can grasp the grommet cap 14 by the rim 46 and un-mount the grommet cap 14 from the grommet 12 by pulling as described above with reference to FIG. 3. The user can pull the grommet cap 14, along with the extension cord 16, to any desired location on the table 74, as illustrated in FIG. 4B. Because the extension cord 16 is flexible, the user can position the grommet cap 14 at any desired location and angle relative to the grommet 12. The distance the grommet cap 14 can be pulled from the grommet 12 is only limited by the length of the cord 26. The user can then plug the desired electronic device into the socket 24. The first end 18 of the extension cord 16 can be plugged into an electrical socket 76 such that electrical power can be provided to the electronic device when it is plugged into the socket 24. When the user no longer desires to use the guest connection assembly 10, the grommet cap 14 can be re-mounted within the grommet 12, thus storing the guest connection assembly 10 in a convenient location which does not take up a lot of surface area on the table 74.

Figure 5A:
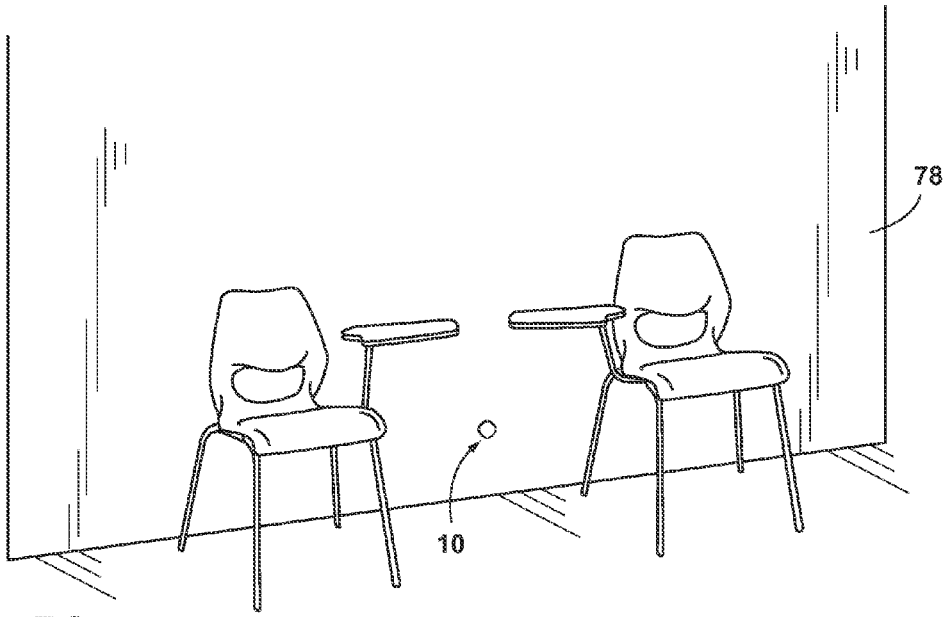
FIGS. 5A and 5B illustrate a method of use of a guest connection assembly on a vertical surface according to a fourth embodiment of the invention.
Figure 5B:
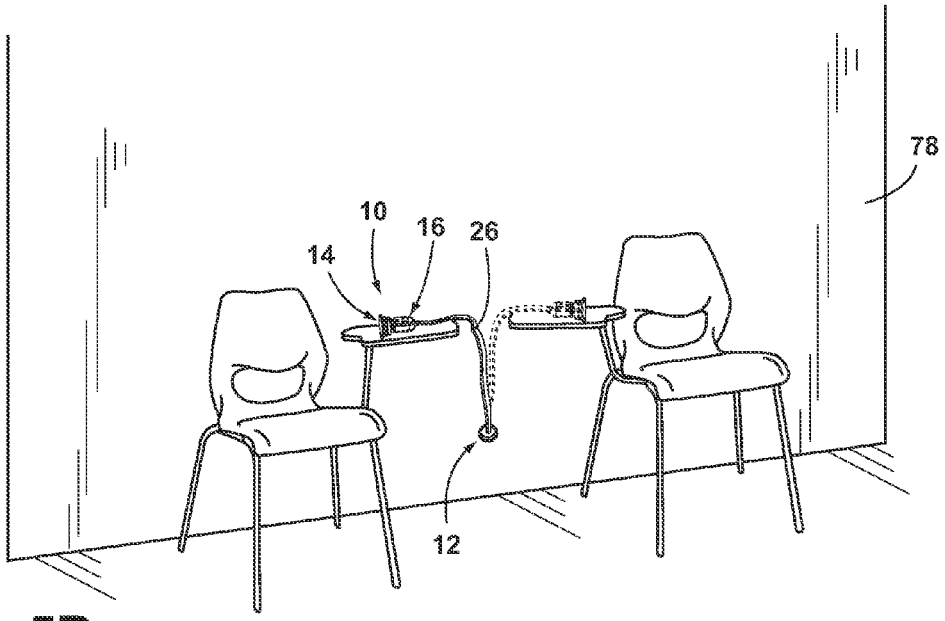

FIGS. 5A and 5B illustrate the use of the guest connection assembly 10 mounted on a vertical surface 78, such as a wall, for example. When not in use, as illustrated in FIG. 5A, the grommet cap 14 and extension cord 16, including cord 26 are stored behind the wall 78, decreasing the chance that someone might step on or trip over the guest connection assembly 10.

The guest connection assembly 10 mounted on the vertical surface 78 can be used in the same manner as that described above for the guest connection assembly 10 mounted on a horizontal surface. The user can un-mount the grommet cap 14 and pull the grommet cap 14 and extension cord 16 to a desired location, as illustrated in FIG. 5B. Because the extension cord 16 is flexible, the grommet cap 14 can be pulled to any desired position relative to the grommet 12, the distance limited only by the length of the cord 26.

Figure 6:
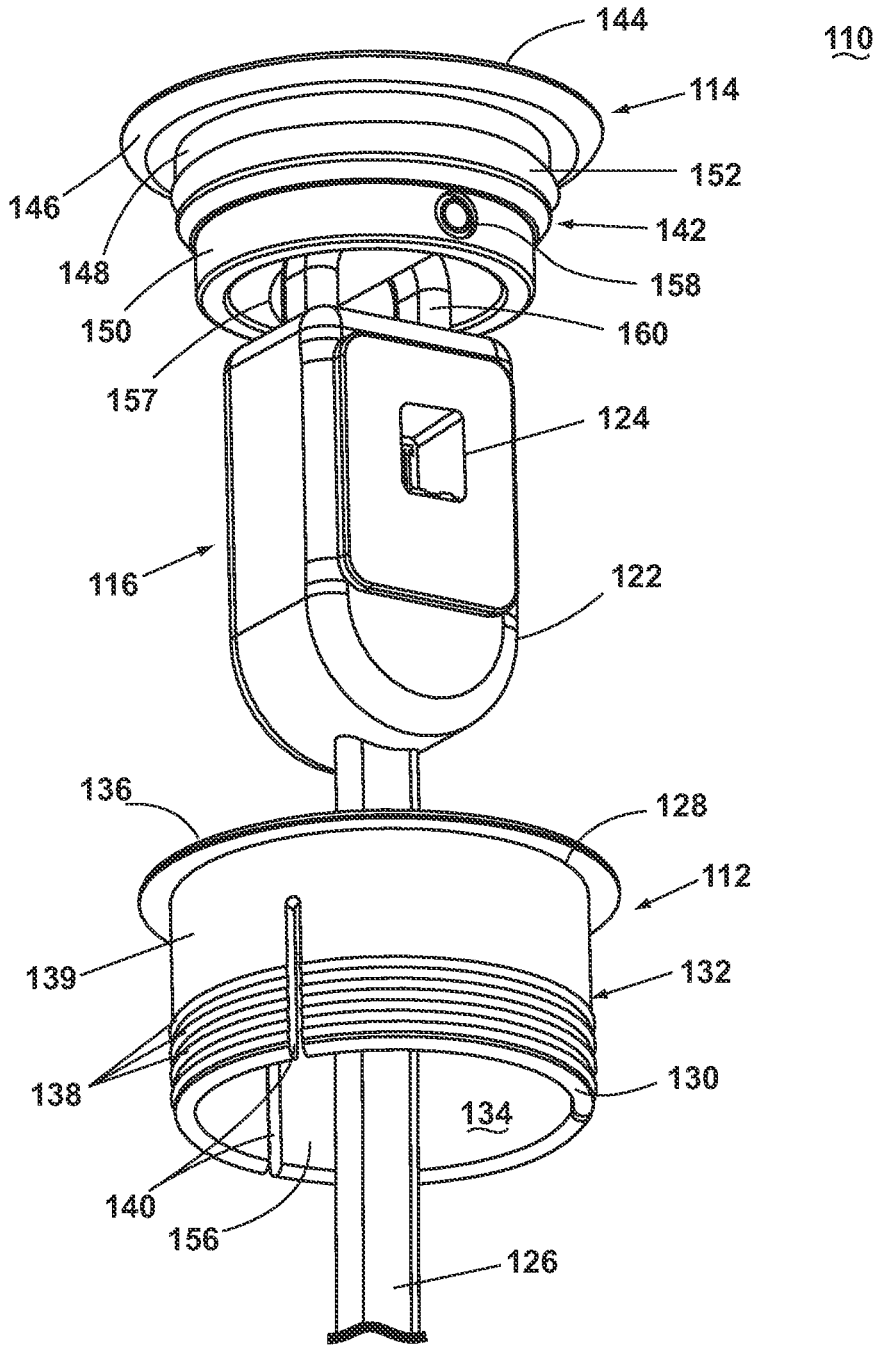
FIG. 6 is a perspective view of a guest connection assembly according to a fifth embodiment of the invention.

FIG. 6 illustrates another embodiment of the invention comprising a guest connection assembly 110, which is similar to the guest connection assembly 10, except for a socket 124. Therefore, elements in the guest connection assembly 110 similar to those of the guest connection assembly 10 will be numbered with the prefix 100.

The guest connection assembly 110 comprises a grommet 112 and a grommet cap 114 coupled with an extension cord 116 in a manner similar to that described above for the guest connection assembly 10. The grommet cap 114 can be moved between a mounted, stored position within the grommet 112 and an un-mounted, use position by pulling the grommet cap 114 away from the grommet 112 in the same manner as described above with respect to the guest connection assembly 10.

The extension cord 116 can have a second end 122 which includes a socket 124. In the embodiment illustrated in FIG. 6, the socket 124 can be configured to receive a network plug. According to this embodiment, cord 126 is in the form of a network cable having a network plug at a first end (not shown), opposite the second end 122, for connecting with a network connection remote from the guest connection assembly 110.

Figure 7:
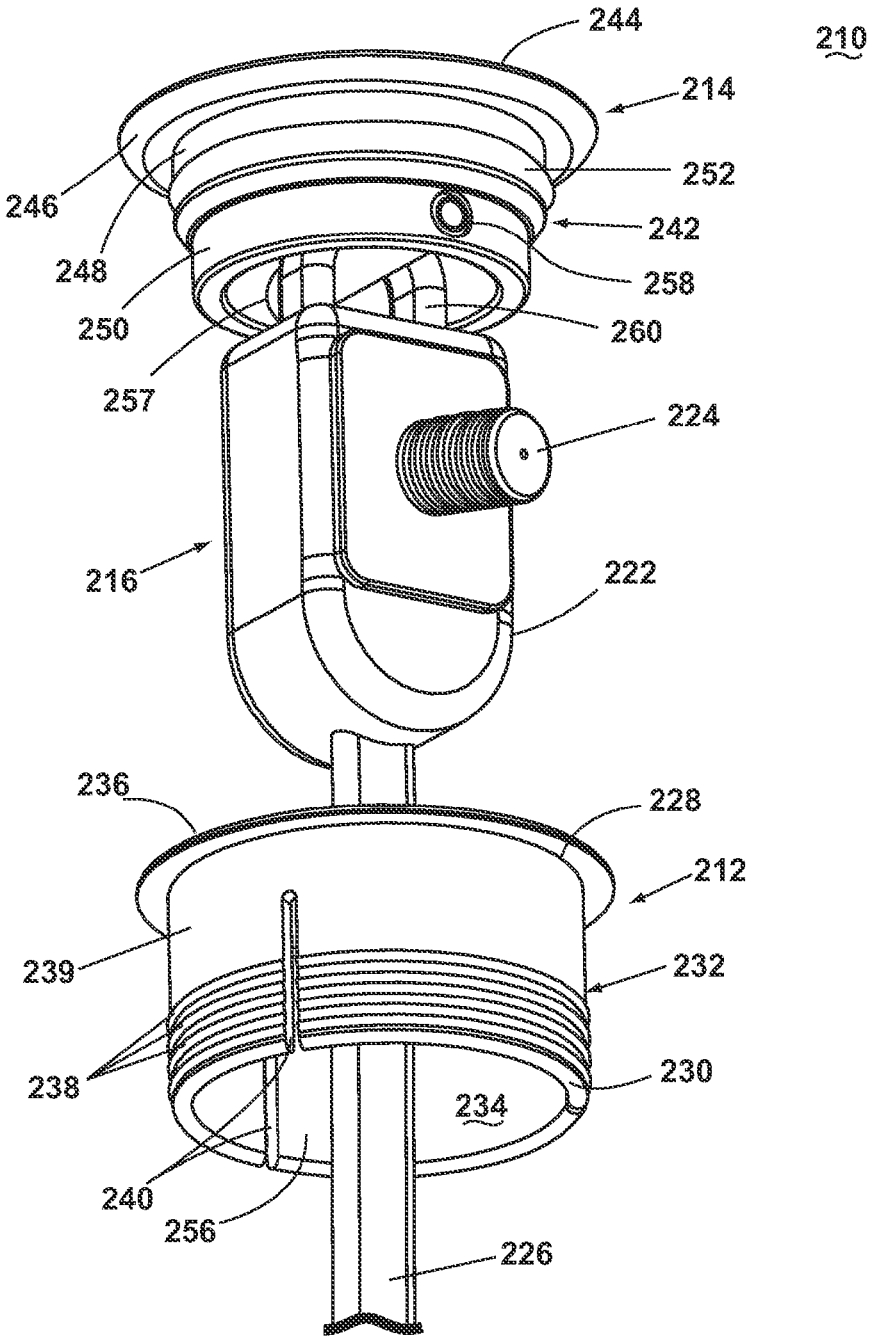
FIG. 7 is a perspective view of a guest connection assembly according to a sixth embodiment of the invention.

FIG. 7 illustrates another embodiment of the invention comprising a guest connection assembly 210, which is similar to the guest connection assembly 10, except for a socket 224.

Therefore, elements in the guest connection assembly 210 similar to those of the guest connection assembly 10 will be numbered with the prefix 200.

The guest connection assembly 210 comprises a grommet 212 and a grommet cap 214 coupled with an extension cord 216 in a manner similar to that described above for the guest connection assembly 10. The grommet cap 214 can be moved between a mounted, stored position within the grommet 212 and an un-mounted, use position by pulling the grommet cap 214 away from the grommet 212 in the same manner as described above with respect to the guest connection assembly 10.

The extension cord 216 can have a second end 222 which includes a socket 224. In the embodiment illustrated in FIG. 7, the socket 224 can be configured to receive a coaxial cable connector. According to this embodiment, cord 226 is in the form of a coaxial cable having a coaxial cable connector at a first end (not shown), opposite the second end 222, for connecting with a data connection remote from the guest connection assembly 210.

Figure 9:
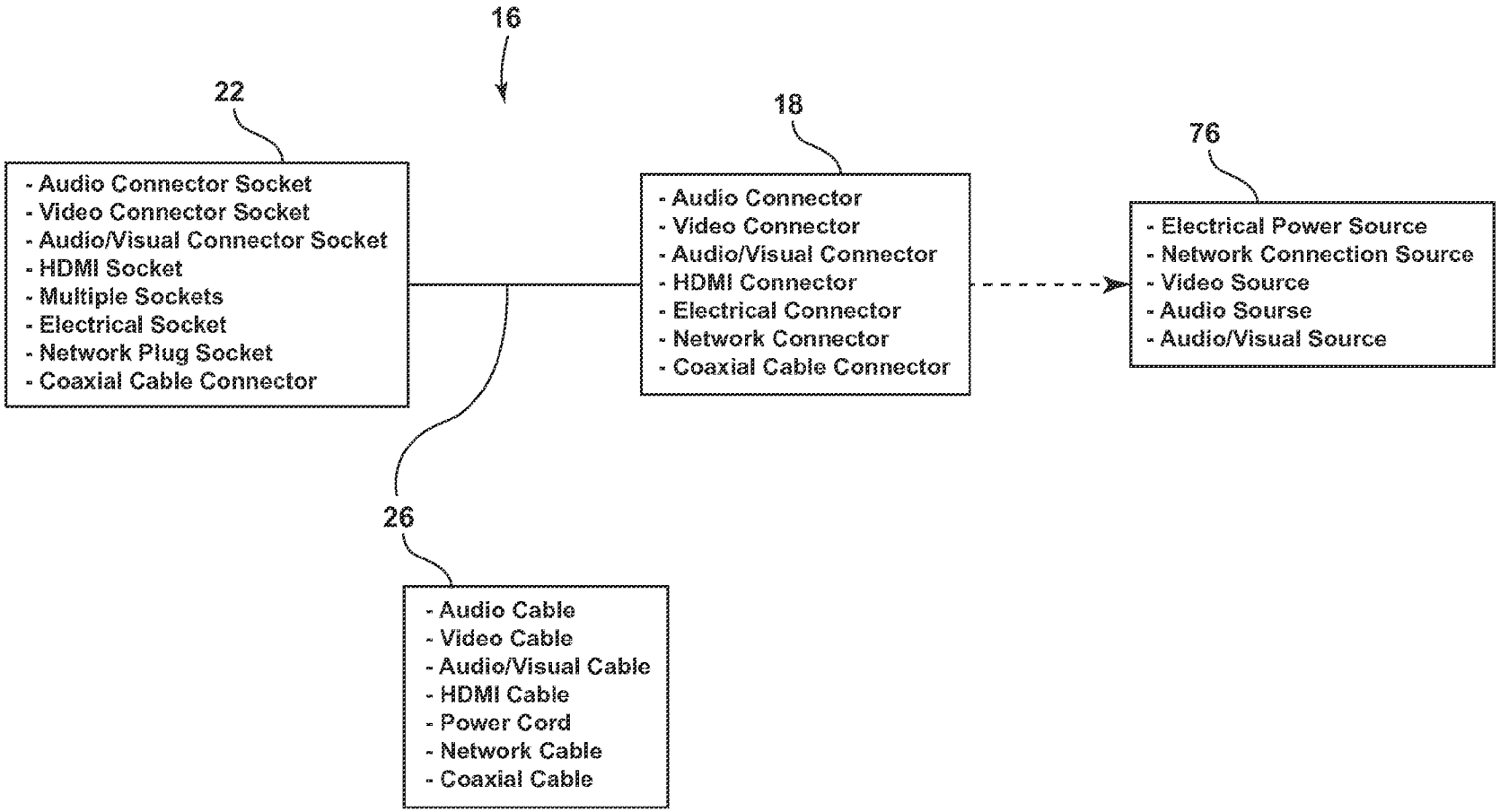
FIG. 9 is a schematic representation of a guest connection assembly according to an embodiment of the invention.

While the guest connection assemblies 10, 110 and 210 have been illustrated as having an electrical socket, network plug socket and coaxial cable connector, respectively, the invention is not limited to only these types of connections. It is within the scope of the invention for the guest connection assembly to be configured to receive and transmit electrical power and/or data through any correspondingly suitable cord and to configure the socket to couple with any known coupling device provided for use with an electronic device. Non-limiting examples of sockets contemplated for use include an audio connector socket, a video connector socket, an audio visual socket and a high definition multimedia interface HDMI socket and the corresponding cords associated with each type of socket. FIG. 9 is a graphical representation of the guest connection assembly 10 illustrating the exemplary connectors, sockets and cords herein described.

It is also within the scope of the invention for the second end 22, 122 and 222 to comprise one or more sockets 24, 124 and 224 and/or any combination of sockets. In addition, the cord 26, 126 and 226 can be provided at any desired length.

The guest connection assembly as described herein provides a compact, flexible, temporary connection which is relatively inexpensive to manufacture and easy to install and replace. The guest connection assembly is compact and takes up very little surface area in both the mounted and un-mounted position. The use of a grommet cap and grommet is simpler and less expensive to manufacture than systems which comprise complex slide and rotation mechanisms having multiple parts.

Because the extension cord is moveable relative to the grommet, the second end having the socket is flexible relative to the grommet and can be pulled in any desired direction away from the grommet to meet the needs of the user. The distance the user can pull the socket from the grommet is limited only by the length of the cord. This flexibility allows a single guest connection assembly to be utilized in a variety of locations, spaced from the grommet, to meet the needs of individual users.

Another advantage of the guest connection assembly is that when not in use, the extension cord is stored behind or underneath a surface, decreasing the chances that someone may step on or trip over the extension cord. In addition, when the guest connection assembly is in use, the grommet can be used for cord management of electronic devices and the extra cord length can be tucked into the grommet channel.

The seal on the guest connection assembly can be used to frictionally retain the grommet cap within the grommet such that the guest connection assembly can be mounted on both horizontal and vertical surfaces. In the case of a horizontal surface, the guest connection assembly can be mounted in a surface such that in the mounted position the extension cord extends down below the horizontal surface or alternatively, the guest connection assembly can be mounted such that the extension cord extends upwards from the horizontal surface. For example, the guest connection assembly can be mounted in a table such that the extension cord extends underneath the table in the mounted position or the guest connection assembly can be mounted within a lower surface of an overhead cabinet such that the extension cord extends upwards above the lower surface in the mounted position.

In addition, the seal can also provide a liquid tight seal between the grommet cap and the grommet to prevent liquid spilled on the surface in which the guest connection assembly is mounted from reaching the socket. In this manner, the socket can be protected from damage and, in the case of an electrical socket, can also help prevent electrical shock to a user.

To the extent not already described, the different features and structures of the various embodiments may be used in combination with each other as desired. That one feature may not be illustrated in all of the embodiments is not meant to be construed that it cannot be, but is done for brevity of description. Thus, the various features of the different embodiments may be mixed and matched as desired to form new embodiments, whether or not the new embodiments are expressly described.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A guest connection assembly for a surface having a grommet hole comprising:

an extension cord having a first end adapted to be interconnected to a source and a second end having at least one socket, the first end interconnected with the at least one socket by a cord;

a grommet received over the extension cord and having an inner dimension greater than an outer dimension of the at least one socket; and a grommet cap coupled with the second end of the extension cord and adapted to be positioned with respect to a hole in the grommet so that the extension cord second end is located within the grommet when the grommet cap is positioned above at least a portion of the grommet, the grommet cap having a first portion and the extension cord having a second portion adjacent the second end in alignment with the first portion of the grommet cap connecting the extension cord with the grommet cap;

wherein the source is located at a distance from the grommet in the surface, and the extension cord has a length generally greater than the distance between the source and the grommet so that, when the grommet cap is positioned with respect to the hole in the grommet and the extension cord is coupled thereto, the grommet cap can be withdrawn outwardly with respect to the grommet to locate the second end of the extension cord distal to, and in any direction with respect to, the grommet;

whereby, when the first end of the extension cord is connected to the source and the grommet is mounted within the grommet hole in the surface, the at least one socket on the second end of the extension cord can be selectively exposed and positioned for use by removing the grommet cap from its mounting to the grommet.

2. The guest connection assembly of claim 1 wherein at least one of the grommet cap and the grommet further comprises at least one seal positioned at a mating periphery between the grommet cap and the grommet to seal an interface therebetween.

3. The guest connection assembly of claim 1 wherein the grommet hole is positioned on a horizontal surface.

4. The guest connection assembly of claim 1 wherein the grommet hole is positioned on a vertical surface.

5. The guest connection assembly of claim 1 wherein at least a portion of the grommet cap frictionally engages the grommet to provide resistance against inadvertent removal of the grommet cap from the grommet.

6. The guest connection assembly of claim 1 wherein the second end of the extension cord comprises a plurality of sockets.

7. The guest connection assembly of claim 1 wherein the second end of the extension cord comprises a loop and an underside portion of the grommet cap comprises a bar mounted to a rim of the grommet cap and spaced from the underside portion of the grommet cap, wherein the bar is passed through the loop on the second end of the extension cord to mount the second end of the extension cord to the grommet cap.

8. The guest connection assembly of claim 1 wherein one of the second end of the extension cord and the grommet cap comprises a first retainer and the other of the second end of the extension cord and the grommet cap comprises a second retainer, wherein the first retainer is adapted to be coupled with the second retainer to mount the second end of the extension cord to the grommet cap.

9. The guest connection assembly of claim 1 wherein the first portion of the grommet cap is mounted to the second portion of the extension cord by at least one of an adhesive and a weld.

10. The guest connection assembly of claim 1 wherein at least the first portion of the grommet cap is integrally molded with at least the second portion of the extension cord.

11. The guest connection assembly of claim 1 wherein an outer surface of the grommet cap comprises a grip to facilitate removal thereof from the mounting to the grommet.

12. The guest connection assembly of claim 1 wherein the source comprises at least one of electrical power, a network connection, a video source, an audio source and an audiovisual source.

13. The guest connection assembly of claim 1 wherein the cord comprises at least one of a power cord, a network cable, a coaxial cable, an audio cable, a video cable, an audio visual cable, and an HDMI cable.

14. The guest connection assembly of claim 1 wherein the socket comprises one of an electrical socket, a network cable socket, a coaxial socket, an audio connector socket, a video connector socket, an audio visual socket and an HDMI socket.

15. The guest connection assembly of claim 1 wherein the grommet cap includes an underside having a mechanical fastening portion and a portion adjacent to the second end of the extension cord comprises a cooperating mechanical fastening portion for mechanically attaching the extension cord to the grommet cap.

16. A guest connection assembly for a surface having a grommet hole comprising:

an extension cord having a first end adapted to be interconnected to a source and a second end having at least one socket and a loop, the first end interconnected with the at least one socket by a cord;

a grommet received over the extension cord and having an inner dimension greater than an outer dimension of the at least one socket; and a grommet cap adapted to be selectively mounted to a hole in the grommet and having an underside portion comprising a bar mounted to a rim of the grommet cap and spaced from the underside portion of the grommet cap, wherein the bar is passed through the loop on the second end of the extension cord to mount the second end of the extension cord to the grommet cap;

whereby, when the first end of the cord is connected to the source and the grommet is mounted within the grommet hole in the surface, the at least one socket on the second end of the extension cord can be selectively exposed and positioned for use by removing the grommet cap from its mounting to the grommet.

17. A guest connection assembly for a surface having a grommet hole comprising:

an extension cord having a first end adapted to be interconnected to a source and a second end having at least one socket, the first end interconnected with the at least one socket by a cord;

a grommet received over the extension cord and having an inner dimension greater than an outer dimension of the at least one socket; and a grommet cap adapted to be selectively mounted to a hole in the grommet and including an underside having a mechanical fastening bar portion and an attachment portion adjacent to the second end of the extension cord comprising a cooperating mechanical fastening portion for mechanically attaching the extension cord to the grommet cap;

whereby, when the first end of the cord is connected to the source and the grommet is mounted within the grommet hole in the surface, the at least one socket on the second end of the extension cord can be selectively exposed and positioned for use by removing the grommet cap from its mounting to the grommet.

* * * * *